US006095708A

United States Patent [19]

Butaud

[11] Patent Number: 6,095,708

[45] Date of Patent: Aug. 1, 2000

[54] REFILLABLE DEODORANT DISPENSER

[76] Inventor: Gary V. Butaud, 9543 S. 213th St., Kent, Wash. 98031

[21] Appl. No.: 09/156,120

[22] Filed: Sep. 17, 1998

[51] Int. Cl.[7] ..... B43K 7/00

[52] U.S. Cl. ..... 401/209; 401/213

[58] Field of Search ..... 401/209, 258, 401/98, 88, 213, 216

[56] References Cited

U.S. PATENT DOCUMENTS

| | | | |
|---|---|---|---|
| 4,558,966 | 12/1985 | Mikateit | 401/258 X |
| 4,892,428 | 1/1990 | Grotsch | 401/258 |

FOREIGN PATENT DOCUMENTS

| | | | |
|---|---|---|---|
| 2082124 | 3/1982 | United Kingdom | 401/209 |
| 2168931 | 7/1986 | United Kingdom | 401/209 |

*Primary Examiner*—David J. Walczak

[57] ABSTRACT

A new refillable deodorant dispenser for reducing costs associated with deodorants and antiperspirants. The inventive device includes a generally cylindrical container that holds liquid deodorant therein and has an open upper end and a lower end. A roller ball is rotatably disposed in the container and protrudes from the upper end of the container. A cap portion has a closed upper end and an open lower end. The lower end of the cap portion is removably coupled to the upper end of the container. In one embodiment, the container has a collar portion that is removably coupled to a body portion. The roller ball is rotatably disposed in the collar portion. In another embodiment, a bottom lid is removably coupled to an open lower end of the container. In a third embodiment, the deodorant is a solid stick with a threaded channel in it disposed on a base portion with a threaded aperture extending through it. A lower cap portion is removably coupled to a lower end of the container. The lower cap portion has a threaded rod that extends through the base portion for raising the bottom portion with respect to the bottom end of the container.

6 Claims, 4 Drawing Sheets

10
32
30
36
2
2
34
26
14
22
20
12
24
10
18
14
12
17
15
19

10

32
3
36
30
3
34
26
22
28
20
29
12
17

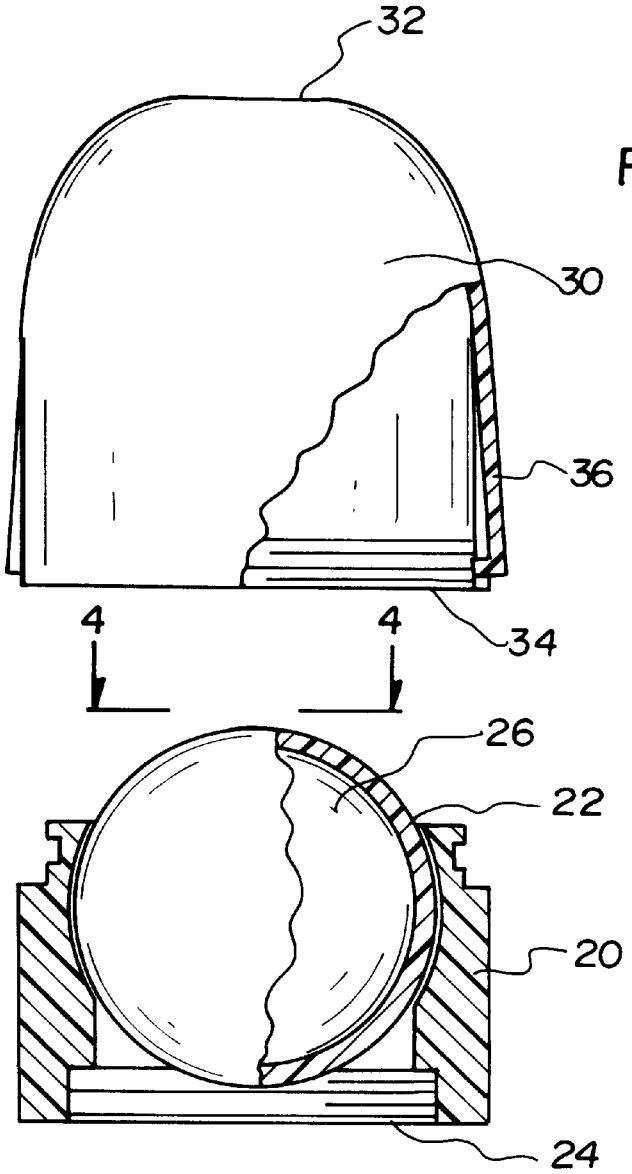
FIG. 3
FIG. 4
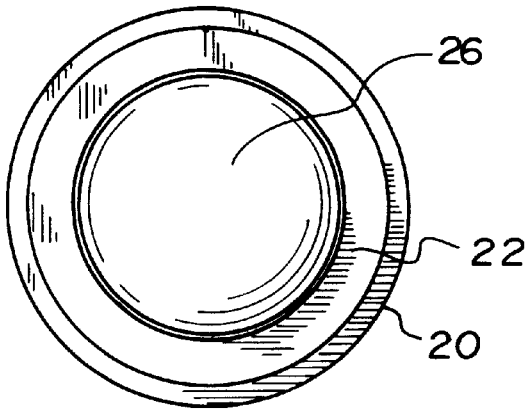

10
50
52
55
54
42
43
40
60
62
63
46
45
65
58
57
67

REFILLABLE DEODORANT DISPENSER

BACKGROUND OF THE INVENTION

1. Field of the Invention

The present invention relates to cosmetic containers and more particularly pertains to a new refillable deodorant dispenser for reducing costs associated with deodorants and antiperspirants.

2. Description of the Prior Art

The use of cosmetic containers is known in the prior art. More specifically, cosmetic containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art cosmetic containers include U.S. Pat. No. 5,007,775 to Thompson; U.S. Pat. No. 4,664,547 to Rosenwinkel; U.S. Pat. No. Des. 333,977 to Gatrost et al.; U.S. Pat. No. Des. 292,069 to Keeler et al.; U.S. Pat. No. 5,137,185 to Mitchell; and U.S. Pat. No. 4,984,718 to Cardia.

While these devices fulfill their respective, particular objectives and requirements, the aforementioned patents do not disclose a new refillable deodorant dispenser. The inventive device includes a generally cylindrical container that holds liquid deodorant therein and has an open upper end and a lower end. A roller ball is rotatably disposed in the container and protrudes from the upper end of the container. A cap portion has a closed upper end and an open lower end. The lower end of the cap portion is removably coupled to the upper end of the container. In one embodiment, the container has a collar portion that is removably coupled to a body portion. The roller ball is rotatably disposed in the collar portion. In another embodiment, a bottom lid is removably coupled to an open lower end of the container. In a third embodiment, the deodorant is a solid stick with a threaded channel in it disposed on a base portion with a threaded aperture extending through it. A lower cap portion is removably coupled to a lower end of the container. The lower cap portion has a threaded rod that extends through the base portion for raising the bottom portion with respect to the bottom end of the container.

In these respects, the refillable deodorant dispenser according to the present invention substantially departs from the conventional concepts and designs of the prior art, and in so doing provides an apparatus primarily developed for the purpose of reducing costs associated with deodorants and antiperspirants.

SUMMARY OF THE INVENTION

In view of the foregoing disadvantages inherent in the known types of cosmetic containers now present in the prior art, the present invention provides a new refillable deodorant dispenser construction wherein the same can be utilized for reducing costs associated with deodorants and antiperspirants.

The general purpose of the present invention, which will be described subsequently in greater detail, is to provide a new refillable deodorant dispenser apparatus and method which has many of the advantages of the cosmetic containers mentioned heretofore and many novel features that result in a new refillable deodorant dispenser which is not anticipated, rendered obvious, suggested, or even implied by any of the prior art cosmetic containers, either alone or in any combination thereof.

To attain this, the present invention generally comprises a generally cylindrical container that holds liquid deodorant therein and has an open upper end and a lower end. A roller ball is rotatably disposed in the container and protrudes from the upper end of the container. A cap portion has a closed upper end and an open lower end. The lower end of the cap portion is removably coupled to the upper end of the container. In one embodiment, the container has a collar portion that is removably coupled to a body portion. The roller ball is rotatably disposed in the collar portion. In another embodiment, a bottom lid is removably coupled to an open lower end of the container. In a third embodiment, the deodorant is a solid stick with a threaded channel in it disposed on a base portion with a threaded aperture extending through it. A lower cap portion is removably coupled to a lower end of the container. The lower cap portion has a threaded rod that extends through the base portion for raising the bottom portion with respect to the bottom end of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new refillable deodorant dispenser apparatus and method which has many of the advantages of the cosmetic containers mentioned heretofore and many novel features that result in a new refillable deodorant dispenser which is not anticipated, rendered obvious, suggested, or even implied by any of the prior art cosmetic containers, either alone or in any combination thereof.

It is another object of the present invention to provide a new refillable deodorant dispenser which may be easily and efficiently manufactured and marketed.

It is a further object of the present invention to provide a new refillable deodorant dispenser which is of a durable and reliable construction.

An even further object of the present invention is to provide a new refillable deodorant dispenser which is susceptible of a low cost of manufacture with regard to both materials and labor, and which accordingly is then susceptible of low prices of sale to the consuming public, thereby making such refillable deodorant dispenser economically available to the buying public.

Still yet another object of the present invention is to provide a new refillable deodorant dispenser which provides in the apparatuses and methods of the prior art some of the advantages thereof, while simultaneously overcoming some of the disadvantages normally associated therewith.

Still another object of the present invention is to provide a new refillable deodorant dispenser for reducing costs associated with deodorants and antiperspirants.

Yet another object of the present invention is to provide a new refillable deodorant dispenser which includes a generally cylindrical container that holds liquid deodorant therein and has an open upper end and a lower end. A roller ball is rotatably disposed in the container and protrudes from the upper end of the container. A cap portion has a closed upper end and an open lower end. The lower end of the cap portion is removably coupled to the upper end of the container. The container has a collar portion that is removably coupled to a body portion. The roller ball is rotatably disposed in the collar portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a top plan view of the present invention as taken along line 4—4 of FIG. 3.

DESCRIPTION OF THE PREFERRED EMBODIMENT

Figure 1:
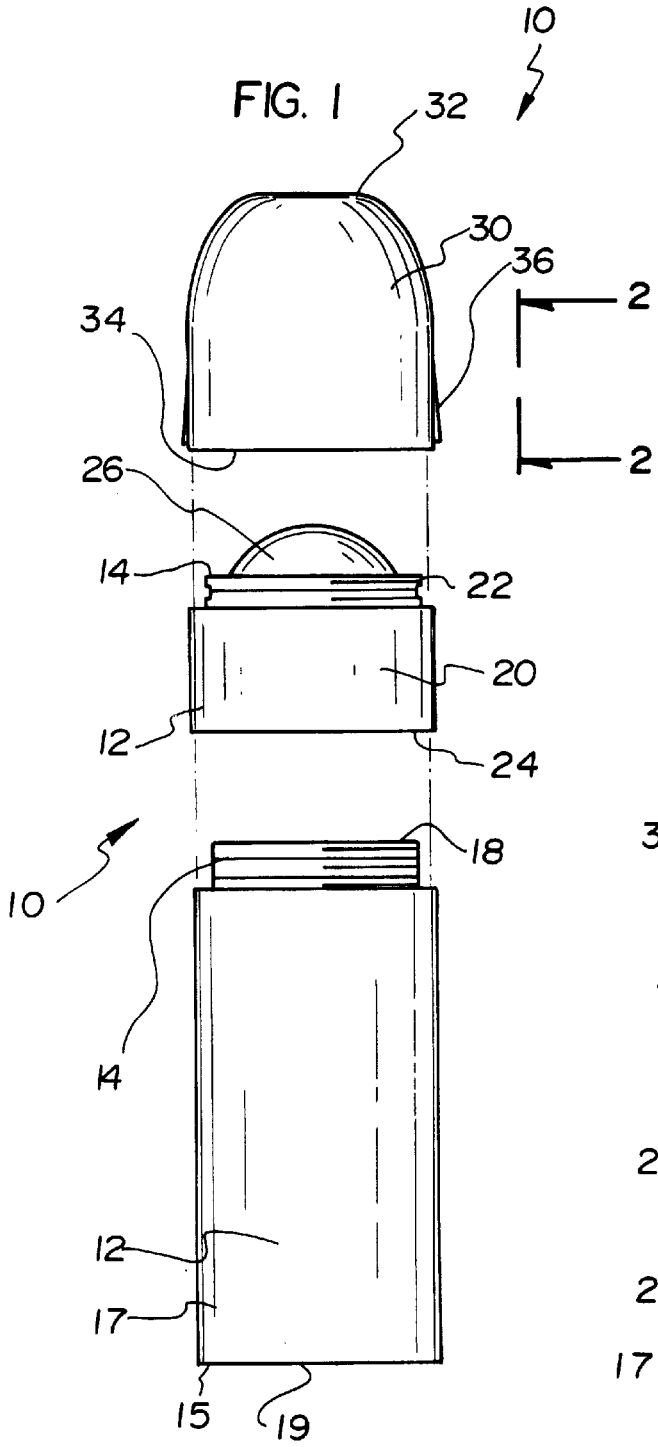
FIG. 1 is an exploded front view of a new refillable deodorant dispenser according to the present invention.

With reference now to the drawings, and in particular to FIGS. 1 through 7 thereof, a new refillable deodorant dispenser embodying the principles and concepts of the present invention and generally designated by the reference numeral 10 will be described.

As best illustrated in FIGS. 1 through 7, the refillable deodorant dispenser 10 comprises a generally cylindrical container 12 that holds liquid deodorant therein and has an open upper end 14 and a lower end 15. A roller ball 26 is disposed within the container 12 and protrudes from the upper end 14 of the container 12. A cap portion 30 has a closed upper end 32 and an open lower end 34 . The lower end 34 of the cap portion 30 is removably coupled to the upper end 22 of the container 12.

Figure 2:
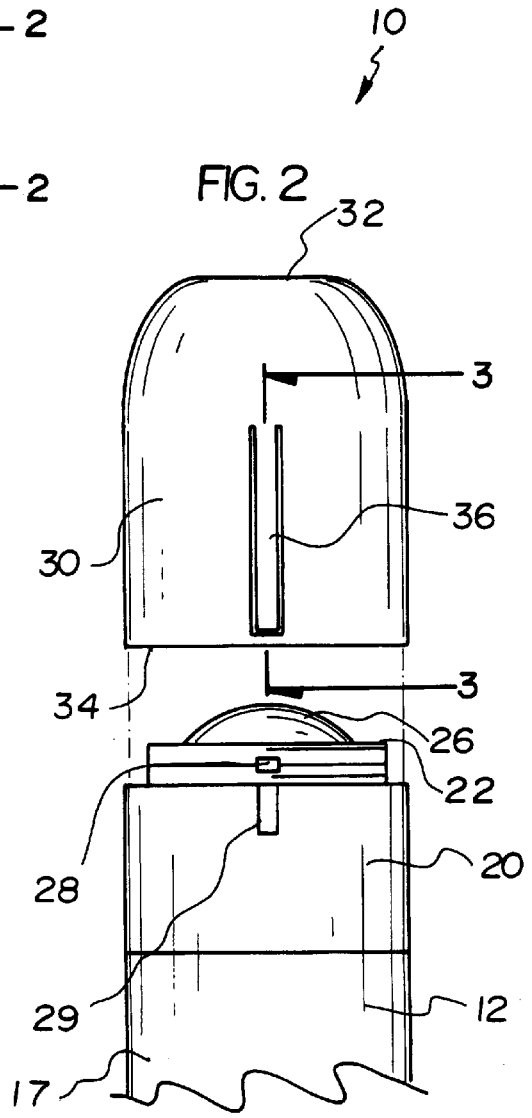
FIG. 2 is a side view of the present invention as taken along line 2—2 of FIG. 1.

Preferably, as shown in FIGS. 1 and 2, the container 12 has a body portion 17 and a collar portion 20. The body portion 17 of the container 12 has a closed lower end 19 and an open upper end 18. The collar portion 20 has an open upper end 22 and an open lower end 24. The lower end 24 of the collar portion 20 is removably coupled to the upper end 18 of the body portion 17 of the container 12. The roller ball 26 is disposed in the collar portion 20 and protrudes from the upper end 22 of the collar portion 20.

More preferably, the upper end 22 of the collar portion 20 of the container 12 is externally threaded. The lower end 34 of the cap portion 30 is internally threaded such that it may be threadedly coupled to the upper end 22 of the collar portion 20 of the container 12.

Also preferably, the upper end 18 of the body portion 17 of the container 12 is externally threaded. The lower end 24 of the collar portion 20 is internally threaded such that it may be threadedly coupled to the upper end 18 of the body portion 17 of the container 12.

Also preferably, the upper end 22 of the collar portion 20 has a pair of diametrically opposed notches 28 formed therein. The cap portion 30 has a pair of diametrically opposed flexible pins 36 that are extendable therein such that the pins 36 engage the notches 28 of the collar portion 20 to facilitate removal of the collar portion 20 with respect to the body portion 17 of the container 12. The pins 36 are squeezed towards each other and the cap portion 30 is rotated until the pins 36 engage the notches 28 of the collar portion 20. With the pins 36 still squeezed together, the cap portion 30 is rotated such that the collar portion 20 of the container 12 is removed from the body portion 17 of the container 12. Deodorant is placed in the body portion 17 of the container 12 and the collar portion 20 is coupled to the body portion 17 of the container 12.

In a variation of the invention, the lower end 34 of the cap portion 30 extends beyond the threaded portion of the upper end 22 of the collar portion 20 of the container 12. The collar portion 20 has a pair of diametrically opposed slots 29 formed therein and positioned below the threaded portion of the upper end 22 of the collar portion 20. The pins 36 are squeezed towards each other and the cap portion 30 is rotated until the pins 36 engage the slots 29 of the collar portion 20. With the pins 36 still squeezed together, the cap portion 30 is rotated such that the collar portion 20 of the container 12 is removed from the body portion 17 of the container 12.

Figure 6:
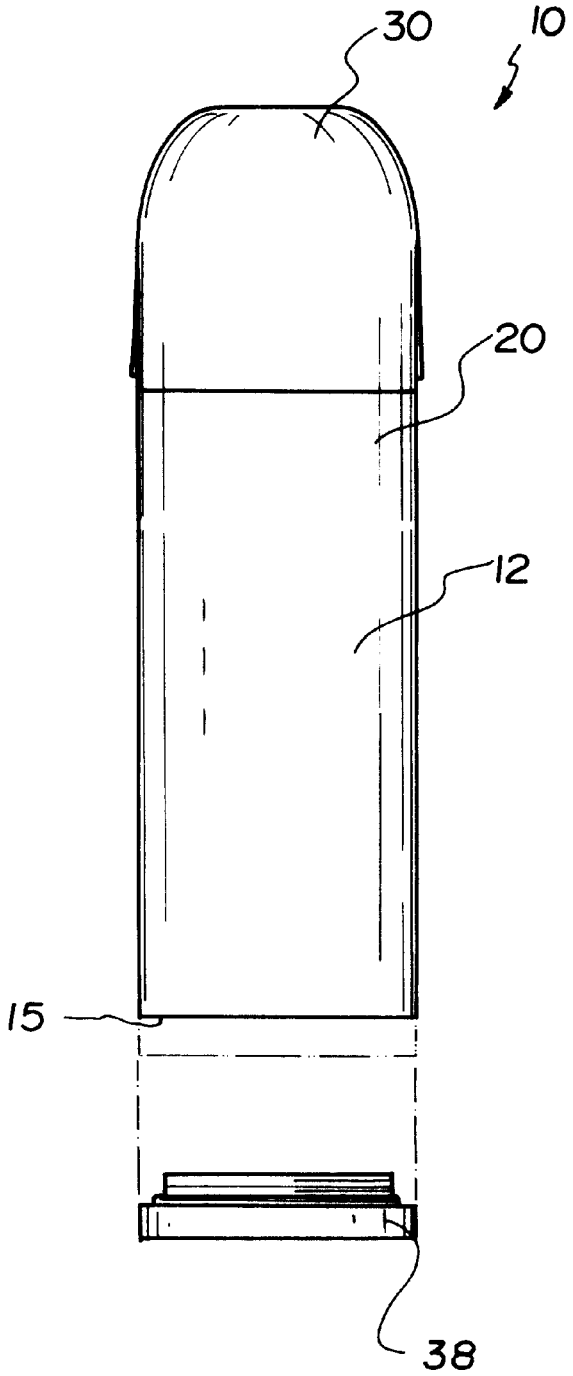
FIG. 6 is a front view of a second embodiment of the present invention.

In a second embodiment, as shown in FIG. 6, the lower end 15 of the container 12 is open. The lower end 15 of the container 12 has a bottom lid 38 that is removably coupled to it. The bottom lid 38 may be removed for insertion of deodorant into the container 12.

Figure 7:
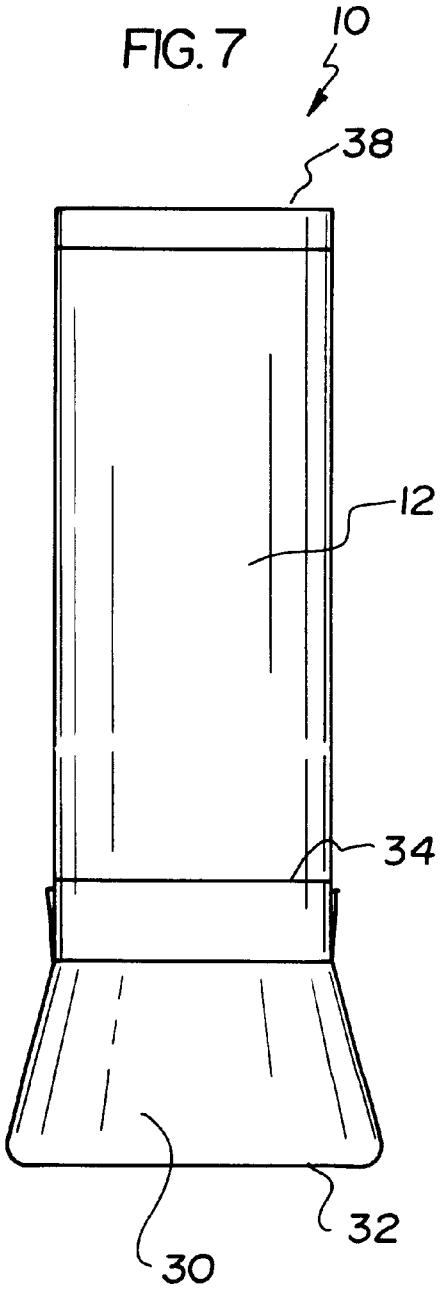
FIG. 7 is a front view of a third embodiment of the present invention.

In a third embodiment, as shown in FIG. 7, the cap portion 30 is tapered outwardly from the lower end of the cap portion 30 towards the upper end of the cap portion 30. The upper end of the cap portion 30 is adapted for resting on a surface. This permits positioning of the container 12 with the roller ball towards the surface so that deodorant remaining in the container 12 remains in constant contact with the roller ball 26. This also keeps deodorant away from the seal of the bottom lid 38.

Figure 5:
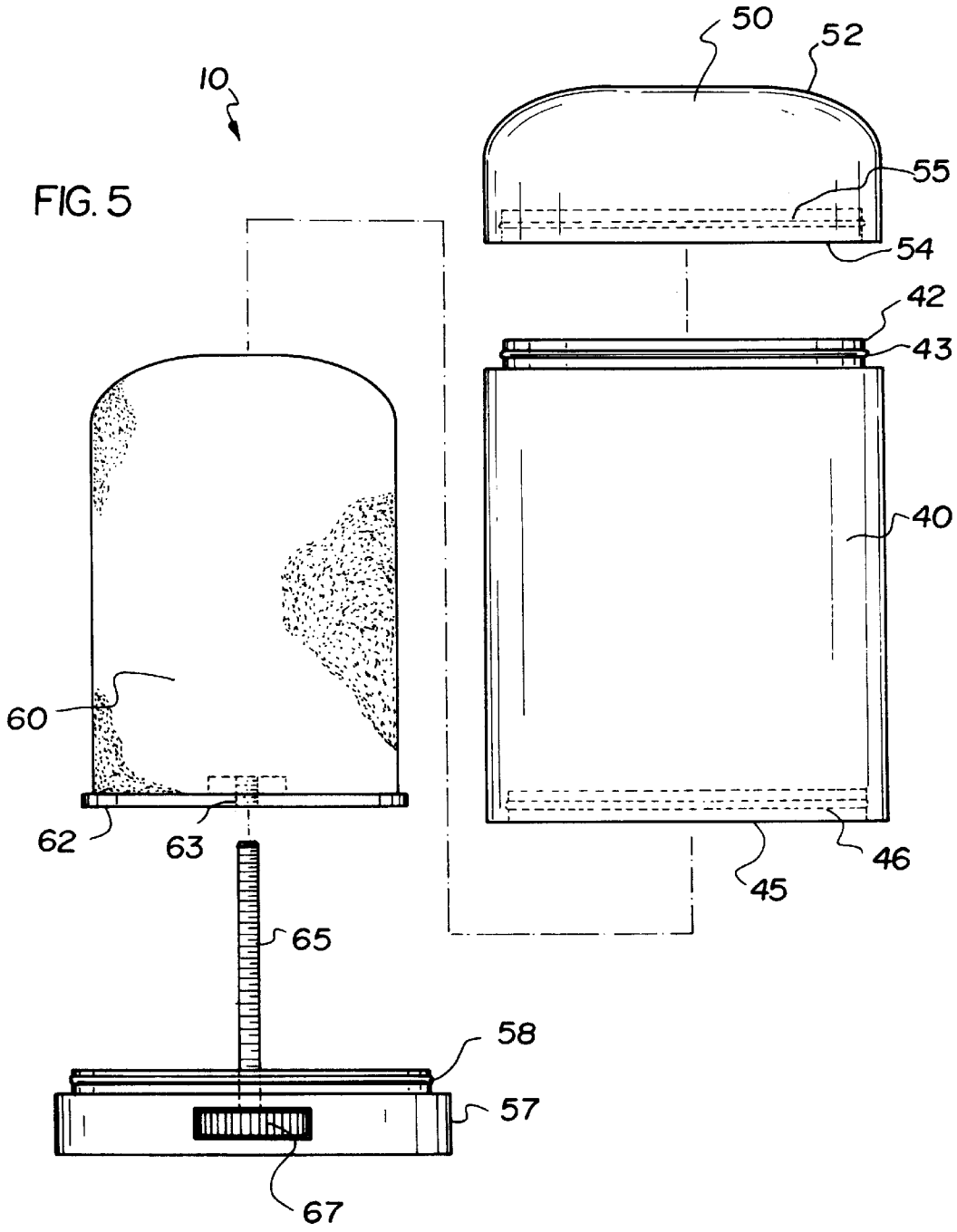
FIG. 5 is an exploded front view of a fourth embodiment of the present invention.

In a fourth embodiment, as shown in FIG. 5, the refillable deodorant dispenser 10 comprises a container 40 that is generally cylindrical and has an open top end 42 and an open bottom end 45. The container 40 holds deodorant therein. An upper cap portion 50 has a closed upper end 52 and an open lower end 54. The lower end 54 of the upper cap portion 50 is removably coupled to the top end 42 of the container 40. A lower cap portion 57 is removably coupled to the bottom end 45 of the container 40.

Preferably, the deodorant is a solid stick 60 that is disposed on a base portion 62. The solid stick 60 and base portion 62 are received within the bottom end 45 of the container 40. The solid stick 60 has a channel therein which may be threaded. The base portion 62 has a threaded aperture 63 extending therethrough.

More preferably, the lower cap portion 57 has a threaded rod 65 that extends through the threaded aperture 63 of the base portion 62 and into the channel of the solid stick 60. The lower cap portion 57 has an adjustment knob 67 that is coupled to the threaded rod 65 for selectively rotating the threaded rod 65. As the threaded rod 65 is rotated, the base portion 62 and the solid stick 60 are raised or lowered with respect to the bottom end 45 of the container 40 to permit extension of the solid stick 60 through the open top end 42 of the container 40.

Also preferably, the top end 42 of the container 40 has a tongue 43 that extends from it around an inner perimeter thereof. The lower end 54 of the upper cap portion 50 has a groove 55 that extends around an external perimeter thereof such that the upper cap portion 50 is removably snapped in place on the top end 42 of the container 40.

Preferably, the bottom end 45 of the container 40 has a groove that extends around an internal perimeter thereof. The lower cap portion 57 has a tongue 58 that extends therefrom around an external perimeter thereof such that the lower cap portion 57 is removably snapped in place on the bottom end 45 of the container 40.

When the solid stick 60 of deodorant is exhausted, the lower cap portion 57 is removed from the container 40 and the base portion 62 is removed. A new solid stick (not shown) is disposed on the base portion 62. The threaded rod 65 is inserted in the threaded aperture 63 of the base portion 62 and rotated until the base member is positioned towards the lower cap portion 57. The solid stick 60 and base portion 62 are inserted in the bottom end 45 of the container 40 and the lower cap portion 57 is coupled to the container 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refillable deodorant dispenser for reducing costs associated with deodorants and antiperspirants comprising:

a generally cylindrical container having a body portion and a collar portion, said container having an open upper end and a lower end, said container holding liquid deodorant therein;

a roller ball being disposed in said container, said roller ball protuding from said upper end of said container; and a cap portion having a closed upper end and an open lower end, said lower end being removably coupled to said upper end of said cantainer;

wherein said upper end of said collar portion has a pair of diametrically opposed notches formed therein, said cap portion having a pair of diametrically opposed flexible pins formed thereon and adapted for selective engagement with said notches in said collar portion, said flexible pins being biased into an inoperative postion wherein said flexible pins are disengaged from said notches and permitting rotation of said cap portion from said collar portion to permit removal of said cap portion from said collar portion, said flexible pins being movable by finger pressure into an operative position wherein said flexible pins are moved into engagement with the notches of said collar portion for locking the cap portion to the collar portion against relative rotation therebetween for facilitating removal of said collar portion with respect to said body portion of said container.

2. The refillable deodorant dispenser of claim 1, wherein said body portion of said container having a closed lower end and an open upper end, said collar portion having an open upper end and an open lower end, said lower end of said collar portion being removably coupled to said upper end of said body portion of said continer, said roller ball being disposed in said collar portion, said roller ball protruding from said upper end of said collar portion.

3. The refillable deodorant dispenser of claim 2, wherein said upper end of said collar portion of said container is externally threaded, said lower end of said cap portion being internally threaded for coupling with said upper end of said collar portion of said container.

4. The refillable deodorant dispenser of claim 2, wherein said upper end of said body portion of said container is externally threaded, said lower end of said collar portion being internally threaded for coupling with said upper end of said body portion of said container.

5. The refillable deodorant dispenser of claim 2, wherein said flexible pins are each mounted on a flexible finger formed in said cap portion and extending in a longitudinal direction of the cap portion, said fingers being deflectable in an inward direction to move said pins toward said collar portion when said cap portion is thereadedly engaged with said collar portion.

6. A refillable deodorant dispenser for reducing costs associated with deodorants and antiperspirants comprising, in combination:

a cylindrical container having a body portion and a collar portion;

said body portion of said container having a closed lower end and an externally threaded open upper end;

said collar portion having an externally threaded open upper and an internally threaded open lower end, said lower end of said collar portion being removable coupled to said upper end of said body portion of said container;

a roller ball being disposed within said collar portion, said roller ball protruding from said upper end of said collar portion;

a cap portion having a closed upper end and an internally threaded open lower end, said lower end of said cap portion being removably coupled to said upper end of said collar portion;

wherein said upper end of said collar portion has a pair of diametrically opposed notches formed therein, said cap portion having a pair of diametrically opposed flexible pins formed thereon and adapted for selective engagement with said notches in said collar portion, said flexible pins being biased into an inoperative position wherein said flexible pins are disengaged from said notches and permitting rotation of said cap portion relative to said collar portion to permit removal of said cap portion from said collar portion, said flexible pins being movable by finger pressure into an operative position wherein said flexible pins are moved into engagement with the notches of said collar portion for locking the cap portion to the collar portion against relative rotation therebetween for facilitating removal of said collar portion with respect to said body portion of said container.

* * * * *